US005114520A

United States Patent [19]

Wang, Jr. et al.

[11] Patent Number: 5,114,520

[45] Date of Patent: May 19, 1992

[54] IMAGE TRANSFER APPARATUS AND METHOD

[75] Inventors: Paul J. Wang, Jr., Woodbury; Michael J. Petrich, Lake Elmo; Francis A. Wadzinski, Madison; James E. Guither, St. Paul, all of Minn.

[73] Assignee: Minnesota Mining and Manufacturing Company, St. Paul, Minn.

[21] Appl. No.: 766,764

[22] Filed: Sep. 27, 1991

[51] Int. Cl.[5] ..... B44C 1/00

[52] U.S. Cl. ..... 156/240; 156/234; 156/540; 355/271; 355/279; 430/126

[58] Field of Search ..... 355/271, 273, 277-281, 355/282, 285, 289, 290, 295, 211-213; 219/216; 156/277, 230, 234, 238, 240, 324, 344, 540; 430/98, 99, 124, 126; 226/181, 183; 346/76 PH

[56] References Cited

U.S. PATENT DOCUMENTS

| | | | |
|---|---|---|---|
| 3,075,859 | 2/1959 | Relph et al. | 117/201 |
| 3,415,706 | 12/1968 | Ettre | 156/540 |
| 3,920,880 | 11/1975 | Akiyama et al. | 428/500 |
| 4,015,027 | 3/1977 | Buchau et al. | 430/124 |
| 4,020,204 | 4/1977 | Taylor et al. | 156/240 X |
| 4,201,701 | 5/1980 | Coney | 260/22 |
| 4,208,467 | 6/1980 | Coney | 428/480 |
| 4,440,590 | 4/1984 | Collins et al. | 156/240 X |
| 4,529,650 | 7/1985 | Fitzer et al. | 524/57 |
| 4,565,842 | 1/1986 | Fitzer et al. | 524/57 |
| 4,595,931 | 6/1986 | Toganoh et al. | 346/1.1 |
| 4,612,074 | 9/1986 | Smith et al. | 156/240 X |
| 4,737,224 | 4/1988 | Fitzer et al. | 156/240 |
| 4,773,959 | 9/1988 | Smith et al. | 156/240 X |
| 4,828,638 | 5/1989 | Brown | 156/240 X |
| 4,861,409 | 8/1989 | Hashida et al. | 156/324 X |
| 5,021,318 | 6/1991 | Mayo et al. | 430/99 X |

OTHER PUBLICATIONS

*Xerox Disclosure Journal*, vol. 3, No. 2, Mar./Apr. 1978, p. 115, Swift, Joseph A., "Hard Alloy Fuser Roll Coating".

*Primary Examiner*—A. T. Grimley
*Assistant Examiner*—Matthew S. Smith
*Attorney, Agent, or Firm*—Gary L. Griswold; Walter N. Kinr; Carolyn V. Peters

[57] ABSTRACT

A method and apparatus for the transfer of images from a donor surface to a receptor utilizing heated pressure rolls to cause transfer to the image materials to the receptor.

16 Claims, 1 Drawing Sheet

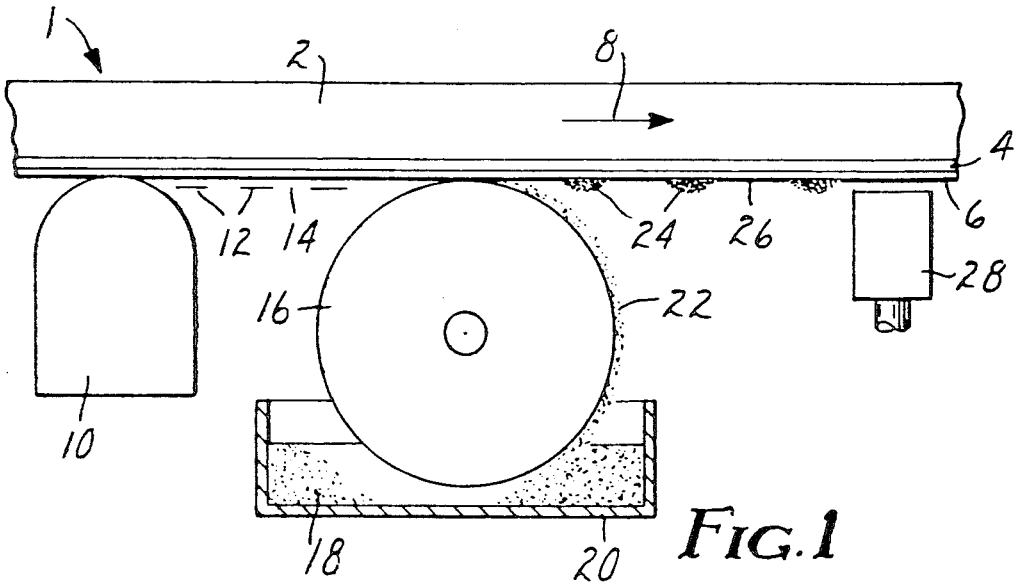
FIG. 1
FIG. 2
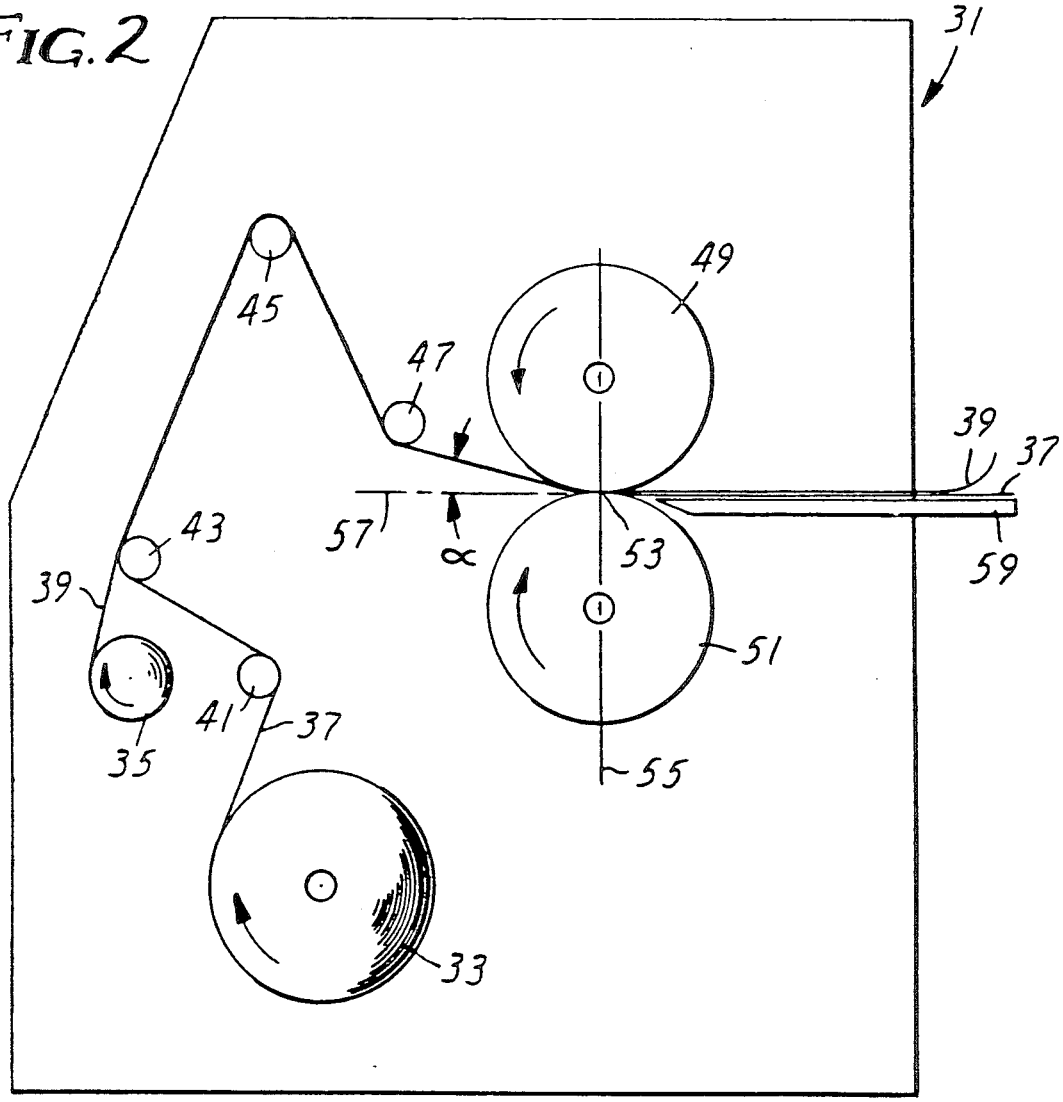

IMAGE TRANSFER APPARATUS AND METHOD

BACKGROUND OF THE INVENTION

1. Field of the Invention

The invention relates to a method and apparatus for the transfer of images from a donor surface to a receptor. More particularly, the invention relates to a continuous method and apparatus utilizing heated pressure rolls to effect contact between the image areas and the receptor and cause transfer of the image materials to the receptor.

2. Description of the Prior Art

U.S. Pat. No. 4,529,650 issued Jul. 16, 1985 entitled "Image Transfer Material" describes a method and apparatus for transferring toned, electrostatic latent images from an electrophotographic member on which they are formed to a carrier, such as a transparent polymeric sheet material, using heat and pressure, to form an imaged transparency. Photoconductive elements similar to those described in this patent are generally relatively thick materials suitable for re-use in a copy machine or other environment and are often in the form of a tensioned belt. As a result, this invention is not concerned with the handling of thin, toned intermediate films, particularly those of substantial width, as in the present invention.

SUMMARY OF THE INVENTION

This invention relates to a method and apparatus for providing stable, high quality, full color images over a large area particularly for outdoor exhibition. More particularly, this invention relates to a method of transferring image materials from a thin, flexible carrier substrate to a durable, vinyl receptor sheet which is suitable for outdoor display. Techniques for depositing images on carrier substrates are well known in the art. However, when large prints are required, especially for exhibit outdoors, the properties of the image carriers are frequently not suitable for the final image support. Typical paper substrates lack the water and ultraviolet radiation resistance required for outdoor display, and more resistant polymeric films, such as vinyl, cannot be imaged directly by certain known techniques, such as by electrographic imaging, because of either their mechanical or electrical properties.

This invention provides a method and apparatus for substantially completely transferring images from a thin, flexible continuous carrier of substantial width, e.g. from about 0.5 meter to about 1 meter or more, to a vinyl substrate to provide optically dense, wrinkle-free sheets useful for high quality, outdoor display.

The method of the present invention for transferring images from a carrier web or sheet to a vinyl receptor sheet comprises holding and continuously feeding a vinyl receptor web into contact with the surface of a continuously fed thin, flexible carrier web having images on at least one of its major surfaces facing the vinyl web. When brought together in the desired alignment, the two webs adhere sufficiently to form a laminated web with the images pressed between the two web materials.

The laminated web is then advanced in a wrinkle-free condition along a path toward a pressure nip formed by a pair of complementary pressure rolls. A key feature of the invention comprises directing the laminated web toward the nip area for a distance between 8 and 30 centimeters from the nip at an angle of up to 12 degrees from a line perpendicular to the common center line of the complementary pressure rolls and passing through the point where the laminated web first contacts the nip.

To effect the transfer, at least one of the pressure rolls is heated and at least one roll is caused to rotate around its axis to cooperate with the other pressure roll to draw the laminated web of material presented to the nip between the rolls and to an exit point on the other side of the nip area. The pressure rolls are urged toward one another to cause the vinyl receptor sheet to intimately contact the images on the carrier web and cause preferential adherence of the images to the vinyl receptor. Once the laminated web exits the heated nip area, the vinyl web and carrier are cooled and separated to complete the transfer of the images to the vinyl receptor web. Substantially complete and wrinkle-free continuous transfer can be accomplished by the use of the present method.

Specific apparatus for use in the invention will be further described in connection with the description of the drawing and the detailed description of the preferred embodiments of the invention.

BRIEF DESCRIPTION OF THE DRAWINGS

FIG. 1 is a diagrammatic representation of one type of printing station useful in forming images to be transferred in accordance with the practice of the present invention.

FIG. 2 is a schematic representation of a toner transfer apparatus and method according to the present invention.

DESCRIPTION OF THE PREFERRED EMBODIMENTS

The image materials which can be thermally transferred in accordance with the present invention are particulate and amorphous materials comprising a film-forming or resinous binder, generally thermoplastic, containing pigments or dyes to provide contrast or color on an imaging substrate. Inks and toners are examples of these well known imaging materials. The imaging materials may be deposited imagewise by a variety of known techniques such as electrography, electrophotography, screen printing, knife or roll coating, rotogravure coating and the like.

One method of depositing images on a carrier is an electrographic method as shown in FIG. 1. In FIG. 1, an intermediate receptor 1 comprises a paper substrate 2 having first a dielectric layer 4 and then a release coating 6 on at least one surface. That surface of the intermediate receptor 1 passes through the station in a direction 8 so that the coated surface of the paper first passes a stylus writing head 10 which imagewise deposits a charge 12 leaving spaces on the surface which are uncharged 14. After passing by the writing head 10, the intermediate receptor 1 then passes a toning station comprising a toner applicator 16 which contacts a liquid toner bath 18 in a container 20. The liquid toner 22 is carried on the toner applicator 16 and is deposited over the entire surface of the intermediate receptor 1 and then removed from the noncharged areas with a vacuum squeegee 28 providing toned areas 24 and untoned areas 26.

At each of these printer stations a separate image is deposited, commonly in one of the four different colors, black, cyan, magenta, and yellow.

Such printers are known in the art and may be obtained for example from Synergy Computer Graphics. The final image is displayed on the dielectric surface of the imaging material.

Another technique that can be used to provide imaged carriers from which the images can be transferred in accordance with the present invention is screen printing. In this well known method, ink comprising thermoplastic resins dissolved in solvents are applied to a carrier by screen printing methods. The techniques and materials for practicing it are described in U.S. Pat. No. 4,737,224, which disclosure is incorporated herein by reference.

The practice of the present invention involves transferring the complete image from the carrier surface to a receptor sheet. The imaging surface of the web carrying the deposited image composition is pressed against the receptor surface and heat is applied for a short time. This may be accomplished by passing the sheets together through heated nip rolls. This invention relates to a novel apparatus and method for accomplishing the transfer.

If the final image on the receptor sheet is to be of high quality and have good color fidelity the transfer must be complete and without distortion of the various color images. Under the conditions of the transfer process the image must therefore be released easily from the carrier surface and adhere to the receptor surface.

FIG. 2 shows a schematic illustration of an image transfer apparatus 31 according to the present invention comprising a vinyl supply roll 33 arranged to continuously feed a vinyl web 37 around a series of cylindrical idler rolls 41, 43, 45, and 47. Cylindrical pressure rolls 49 and 51 are arranged in a complementary manner to form a nip area 53. Pressure rolls 49 and 51 are supported at their ends by movable supports (not shown) capable of urging the rolls toward one another with sufficient pressure to form a nip area 53 and engage and compress web materials fed into the nip 53 formed by the rolls. At least one of the rolls is driven by a drive means, such as a variable speed electric motor or the like (not shown), to cause rolls 49 and 51 to counter-rotate at the desired speed and draw the web through the nip at the desired rate. Generally, the rolls rotate at a speed sufficient to cause the web to pass through the nip at a rate of about 0.38 to about 0.76 meters per minute.

Roll 35 is arranged to continuously feed a previously imaged carrier web 39, such as a paper web, into contact with vinyl web 37 such that the image material comes into contact with the vinyl web. The edges of the web are usually arranged to be in register with the edges or some other portion of the vinyl web so that a laminated web is formed and fed through the transfer apparatus guided by idler rolls 43, 45 and 47 to nip area 53.

When the laminated web (37,39) reaches the nip area 53 it is drawn through the cooperating pressure rolls 49, 51 and pressed together so that the images carried on web 39 are intimately brought into contact with vinyl web 37 and pressed into the surface thereof. In addition, at least the roll contacting web 39 from which the toned images are to be released must be heated to raise the temperature of the web materials as they pass through the nip area.

The two large pressure rolls 49, 51 are supported by means to exert pressure at the nip point. Pressure between the rolls is controlled typically by air or hydraulic cylinders impinging on the two ends of the roll axles and useful nip pressures are typically between 45 and 100 psi (3–7 kg/cm$^2$) depending on the materials being transferred.

The rolls 49, 51 must be long enough to accommodate the desired web widths and typically may be up to 1 meter or more in length to accommodate webs of that width. The rolls must be rigid enough to maintain constant pressure along the full length of the nip. Typically, the rolls are made of steel and are at least 20 cm in diameter and at least the roll contacting web 37 to which the images are to be transferred (the bottom roll in FIG. 2) is covered with about 1.25 cm of silicone rubber having a durometer reading of 55 to 65 on the Shore "A" scale. Optionally, the top roll may also be covered with silicone rubber of the same type, but preferably of about half of the thickness (0.625 cm). At least one of the pressure rolls, preferably the steel roll, may be heated to soften the vinyl receptor web and affect the transfer. Typically a roll temperature of about 195° F. to 250° F. with a web speed of 0.45M/minutes will provide good transfer.

It is preferred that the top roll have a polished steel surface with a polished chrome plating. This provides a smoother web contour as the web passes between the pressure rolls with less chance for wrinkling. The heat emissivity of the polished steel roll is also lower, reducing radiative heat loss which in turn provides better temperature stability of the roll and control over heating of the web as it approaches the nip. The polished chrome roll generally has a longer service life requiring less maintenance.

The length of web under pressure at the nip (often referred to as the "footprint") is determined by the roll diameters, the hardness of the rubber covering as well as the pressure between the rolls.

The angle at which the laminated web is fed to nip 53 is critical to providing a complete, wrinkle-free transfer of the toner from donor 39 to receptor 37. The angle, alpha, shown in FIG. 2 should be between about 8 and 12 degrees in order for the apparatus to function effectively. The angle alpha as shown in FIG. 2 is the angle between the surface of the laminated web and an imaginary line 57 normal to the common centerline 55 of rolls 49 and 51 and through nip 53. If the angle is greater than about 12 degrees, light and dark transfer lines appear on the vinyl substrate, and, because the vinyl web is wrapped further around the heated roll, the heat will wrinkle the vinyl web.

The length of the web between the nip 53 and the point of contact with roll 47 is also critical to good transfer performance. Desirably, this distance is between 8 cm and 30 cm. If this distance is greater than about 30 cm, air entrapment and wrinkling of the web is likely to occur. If the distance is less than about 8 cm, the heating effects from the rolls cause the temperature of the web to remain too high for too long and cause wrinkling of the web.

Acceptable performance with the apparatus shown in FIG. 2 can be obtained with a top roll 49 temperature of from about 195°–250° F., a web speed of 0.45M/min, and a nip pressure of between 3 and 7 kg/cm$^2$. The actual nip pressure used will depend on the type of material being transferred and its relative affinity for the carrier and receptor under the conditions of transfer.

The vinyl web must be uniformly tensioned so that it will remain aligned on the rolls as it traverses the apparatus and so that it will not wrinkle during transfer.

Typically, the tension on the vinyl web will be between about 0.1 kg per cm of web width to about 0.3 kg per cm of web width. Preferably the tension force is about 0.15 kg per cm of web width.

Upon exiting nip area 53 the webs are fed onto support table 59 and, after proper cooling, the image materials are preferentially adhered to the vinyl web 37. The two webs 39 and 37 are then separated by the operator and the images preferentially transfer to vinyl web 37, completing the transfer of images from paper web 39 to vinyl web 37.

The correct choice of carrier sheet and release coating, imaging and receptor materials used in the present invention is important to ensure that full transfer of the image is achieved without damaging the image.

In the practice of the present invention, transferrable images must be created on a carrier sheet and then transferred to a receptor sheet. A variety of materials can be used for each of these elements and will vary somewhat depending on the method used for creating the image. Two well known, representative techniques of image creation, printing using inks and electrostatic imaging using toners, will be described with reference to the practice of the present invention.

In printing, a thermally transferrable ink is used to print a carrier by known printing techniques, such as by screen or gravure printing. The inks generally comprise a thermoplastic resin, a pigment, flexibilizers and other commonly used ingredients dissolved in the appropriate solvent. The carrier may be any flexible material that is dimensionally stable in the plane of the sheet and exhibits the ability to release the ink once it has been adhered to a receptor surface. The carrier often has a suitable release material coated on or impregnated in the carrier to facilitate release. Silicone coated papers and polymeric films are useful.

Receptor sheets that can be used to receive the ink images may be flexible sheets of a polymeric or other composition to which the inks can be adhered preferentially under heat and pressure. Polymeric films such as polyvinyl chloride, acrylates and urethanes, are typical.

Various carriers, thermally transferrable printing inks, inks and receptor sheet materials useful in the present invention, are well known and are described in U.S. Pat. No. 4,737,224, issued Apr. 12, 1988 and entitled "Process of Dry Adhesive-Free Thermal Transfer of Indicia."

Another technique for creating images on a carrier sheet is electrostatic printing as described in connection with FIG. 1. The carrier sheets useful in electrostatic imaging comprise a substrate, preferably flexible one, on one surface of which is a dielectric layer. The substrate itself should be electroconductive or it should carry conductive layers on both major surfaces. The dielectric layer will be on the surface of one of the conductive layers.

Substrates may be chosen from a variety of materials such as cellulose fiber based paper and polyester based plastic film. If a separate conductive layer is required, this may be composed of polyelectrolytes such as cationic quaternary ammonium compounds or polymers containing a chloride anion or other materials known in the art to be stable at room temperature and at the elevated temperatures (e.g., 230° to 270° F.) of the image transfer process.

Dielectric layers on a substrate for use in electrostatic printing processes are well known in the art; see, for example, *Neblette's Handbook of Photography and Reprography*, C.B. Neblette, 7th Edition, 1977. These layers commonly comprise polymers selected from polyvinylacetate, polyvinylchloride, polyvinylbutyral, and polymethylmethacrylate. Other ingredients may be chosen from waxes, polyethylene, alkyd resins, nitrocellulose, ethylcellulose, cellulose acetate, epoxy resins, styrene-butadiene polymers, chlorinated rubbers, and polyacrylates. Performance criteria for dielectric layers are listed in the foregoing Neblette reference. Such layers are also described in U.S. Pat. Nos. 3,075,859; 3,920,880; 4,201,701; and 4,208,467.

The required surface energy characteristics of the carrier may be achieved either by applying a release layer to the free surface of the dielectric, or by modifying the dielectric material. Polymers incorporating dimethylsiloxane units in small and controlled numbers have been found to perform particularly well.

A suitable release layer will have controlled release properties given by incorporating small amounts of moieties such as silicones, but these silicones should be firmly anchored to a polymer insoluble in the toner carrier liquid. The non-silicone part of the release layer material must have a high softening point. An example of such a polymer is a silicone-urea block polymer with between 1% and 10% by weight of polydimethylsiloxane (PDMS). The polymer can be prepared in isopropanol and diluted to 3% solids with further isopropanol for coating on the dielectric surface. Percentages of PDMS above 20% are found to be less preferred because increases in transfer efficiency are negated by decreases in developed image density as PDMS amount increases above 20%. However under less stringent conditions of processing the silicone content can be much higher, even up to 65% or higher. Silicone-urea block copolymers useful with the present invention are described in U.S. Pat. No. 5,045,391 entitled "Release Coatings For Dielectric Substrates", which disclosure is incorporated herein by reference.

Other controlled release layer compositions may be obtained using monomers capable of forming condensation products with silicone units through their amine or hydroxy termination groups, the monomer units being polymerized either during or after the condensation. Examples of such compositions are urethane, epoxy, and acrylics in combination with silicone moieties such as PDMS.

Dielectric layers with built-in release properties have the added advantages of eliminating an extra coating procedure and eliminating any electrical effects of the thickness of a separate release layer. These intrinsic release dielectric layers can comprise one or more polymers combining self-releasing and dielectric moieties, or can comprise a mixture of a release material and a dielectric polymer or resin.

Self-releasing dielectric polymer formulations are copolymers of methylmethacrylate (MMA) with PDMS or terpolymers of MMA, polystyrene, and PDMS. Useful levels of PDMS ranged from 10% to 30% by weight of the total polymer; values in the range 15% to 30% give transfer efficiencies above 90% but optical density of the deposited toner tend to fall at the higher percentages. An optimum value for these polymers is in the range of 10% to 20%. The silicone-urea material referred to earlier in this application for use as a separate release layer on a dielectric layer may also be used by itself as a self-releasing dielectric layer. PDMS contents of 10 weight % and 25 weight % give good imaging properties and transfer efficiencies above 95%.

The dielectric carrier may be prepared by a variety of techniques. The dielectric surface to be treated must first be cleaned of all dirt and grease. The dielectric surface is then contacted with the solution of silicone urea block polymer by the use of one of a variety of techniques such as brushing, bar coating, spraying, roll coating, curtain coating, knife coating, etc.; and then processed at a time and temperature sufficient to cause the silicone urea block polymer to form a dried layer on the surface. For image release coatings, a preferably level of measurement for dried coating thickness is in micron(s) thickness. A suitable range if 0.05 to 2.0 microns, preferably in the range of 0.06 to 0.3 microns, and most preferably in the range of 0.06 to 0.18 microns.

The silicone urea block polymer release coating is applied to the dielectric substrate in an organic, non-aqueous, solvent. If the coating is applied in an aqueous solution, the water is removed upon drying of the coating leaving the polar, non-silicone segments on the surface, and the silicone is left almost totally submerged under the polar non-silicone layer. Therefore, an insufficient quantity of silicone is left on the surface of the release layer for contact with the toner(s). Consequently, there is no toner release capability upon attempted transfer of an image from the dielectric substrate to a receptor substrate.

The non-aqueous polymer solution is diluted in a solvent, such as isopropanol, to give a proper solids concentration and then is coated onto the dielectric material. The thickness of the coating once it is dried can be properly measured by a chemical indicator method if the proper indicator is included within the non-aqueous release material prior to application to the dielectric material.

The latent image is deposited on the release coating by one or more stylus and subsequently toner is applied to the deposited image at one or more toning stations. At this point, the imaged carrier has been created.

Liquid toners useful in electrostatic printing may be selected from types well known in the art. These toners comprise a stable dispersion of toner particles in an insulating carrier liquid which is typically a hydrocarbon. The toner particles carry a charge and comprise a polymer or resin and a colored pigment. However they preferably should satisfy the following general requirements in addition to the interfacial surface energy and scratch strength requirements discussed earlier in this disclosure. These general requirements are:

a) a ratio of less than 0.6, preferably less than 0.4 and most preferably less than 0.3 between the conductivity of the carrier liquid as present in the liquid toner and the conductivity of the liquid toner itself, and b) toner particles with zeta potentials in a narrow range and centered between +60 mV and +200 mV.

The liquid toner preferably also should satisfy the following requirements:

c) deposited toner particles have a $T_g$, less than 100° C. and greater than −20° C., and more preferably less than 70° C. and greater than 10° C., d) substantially monodispersed toner particle sizes with an average diameter in the range 0.1 micron to 0.7 micron, e) a conductivity in the range of $0.1\times10^{-11}$ mho/cm and $20\times10^{-11}$ mho/cm with solids concentration in the liquid toner in the range 0.5 wt.% to 3.0 wt.% and preferably 1.0 wt.% to 2.0 wt.%.

The insulating carrier liquid in these liquid toners has importance related to the robustness of the deposited toner layers during the process as predicted by the scratch test strength. There exists a comprehensive series of hydrocarbon carrier liquids (e.g. the "Isopar" series) with a range of boiling points. "Isopar" liquids C, E, G, H, K, L, M, and V have boiling points respectively of 98° C., 116° C., 156° C., 174° C., 177° C., 188° C., 206°, and 255° C. Mixtures of different members of such a series are often used in liquid toner formulations.

Toners are usually prepared in a concentrated form to conserve storage space and transportation costs. In order to use the toners in the printer, this concentrate is diluted with further carrier liquid to give what is termed the working strength liquid toner. Various methods for preparing useful toners are described in copending U.S. patent application Ser. No. 510,597 entitled "Toner Developed Electrostatic Imaging Process For Outdoor Signs" filed Jan. 3, 1990, which disclosure is incorporated herein by reference.

A variety of materials can be used as receptor sheets for toned images in the present invention. Any flexible sheet material which has sufficient integrity and physical properties to withstand handling in the transfer process and be receptive to toned images is a candidate. The material should have chemical properties which render it suitable for its intended use. For example, if the intended use is for outdoor signage, the material selected should have good weathering properties. The substrate materials preferably should be conformable to the microscopic undulations of the surface of the toned images. Materials such as poly(vinyl chloride) (PVC) conform to the imaging surface well whereas materials such as polycarbonate do not and consequently provide less satisfactory transfer of the toner image. Other materials which may be used as substrates are acrylics, polyurethanes, polyethylene/acrylic acid copolymers, and polyvinyl butyrals. Commercially available composite materials such as "Scotchcal" brand film, and "Panaflex" brand sign face material are also suitable substrates.

What we claim is:

1. A method for transferring images carried on a thin, flexible carrier to a vinyl receptor sheet comprising a) holding and continuously feeding a vinyl web into register contact with the surface of a continuously fed carrier having images thereon to form a laminated web, b) advancing said laminated web in a wrinkle-free condition along a path toward a pressure nip formed by a pair of complementary pressure rolls, c) directing said laminated web toward said nip at an angle of between 8 and 12 degrees from a reference line for a distance between 8 and 30 centimeters from said nip, said reference line being perpendicular to the common center line of the complementary pressure rolls and passing through said nip, d) rotating at least one of said pressure rolls around its axis to cooperate with the other pressure roll to draw said laminated web between said rolls to an exit point on the other side of said nip, said pressure rolls being urged toward one another to cause said vinyl web to intimately contact said images on said carrier and cause preferential adherence of said images to said vinyl web, and e) separating the vinyl web and the carrier whereby said images separate from said carrier and preferentially adhere to said vinyl web.

2. A method according to claim 1 wherein at least the pressure roll in contact with the web carrying said images is heated.

3. A method according to claim 2 wherein said pressure roll is heated to a temperature of about 195° C.

4. A method according to claim 3 wherein said laminated web is advanced through said nip at a rate of about 0.45 meters per minute.

5. A method according to claim 1 wherein said vinyl web entering said nip is tensioned at a force of between 0.1 kg/cm of width and 0.3 kg/cm of width.

6. A method according to claim 1 wherein said complementary pressure rolls comprise at least one roll which has a silicone rubber cover having a Shore A durometer hardness of between 55 and 65.

7. A method according to claim 6 wherein one of said complementary rolls is stainless steel.

8. A method according to claim 6 wherein both of said pressure rolls are rubber covered rolls.

9. Apparatus for transferring images carried on a substrate to a vinyl receptor sheet comprising a) means for holding and feeding a vinyl web, b) means for holding and feeding a carrier web having images on one major surface thereof, c) upper and lower pressure rolls having means to urge said rolls toward one another and form a nip area for receiving a web of material, d) means to rotate at least one of said pressure rolls around its axis to cooperate with the other pressure roll to draw said web of material presented to said nip between said rolls to an exit point on the other side of said nip area, e) a series of idler rolls for bringing the image bearing surface of said carrier web into contact with said vinyl web to form a laminated web and advancing said laminated web in a wrinkle-free condition along a path toward said nip formed by said pressure rolls, f) a final idler roll arranged along the laminated web path between 8 and 30 centimeters from the entry to said nip area, said idler roll arranged to direct the laminated web away from the idler roll at an angle of between 8 and 12 degrees from a reference line perpendicular to the common center line of the pressure rolls and passing through said nip.

10. Apparatus according to claim 9 which further includes means for supporting said laminated web exiting said nip area.

11. Apparatus according to claim 10 which further includes means for separating said carrier web from said vinyl web.

12. Apparatus according to claim 9 wherein said pressure rolls are between 20 cm and 30 cm in diameter and are at least about 1 meter in length.

13. Apparatus according to claim 9 wherein one of said pressure rolls is a heated, polished chrome roll and the other pressure roll is a rubber covered roll.

14. Apparatus according to claim 9 wherein said complementary pressure rolls comprise at least one roll which has a silicone rubber cover having a Shore A durometer hardness of between 55 and 65.

15. Apparatus according to claim 14 wherein one of said complementary rolls is stainless steel.

16. Apparatus according to claim 14 wherein both of said pressure rolls are rubber covered rolls.

* * * * *

UNITED STATES PATENT AND TRADEMARK OFFICE

CERTIFICATE OF CORRECTION

PATENT NO. : 5,114,520

DATED : May 19, 1992

INVENTOR(S) : Wang, Jr., et al.

It is certified that error appears in the above-identified patent and that said Letters Patent is hereby corrected as shown below:

Col. 7, line 61, Replace "10°C.," with -- -10°C.,--

Signed and Sealed this

Fourteenth Day of September, 1993

Bruce Lehman

*Attest:*

BRUCE LEHMAN

*Attesting Officer*

*Commissioner of Patents and Trademarks*